United States Patent [19]

Ibrahim

[11] 4,347,710

[45] * Sep. 7, 1982

[54] GLASS DOOR MERCHANDIZER WITH TERTIARY AIR BAND

[75] Inventor: Fayez F. Ibrahim, Niles, Mich.

[73] Assignee: Tyler Refrigeration Corporation, Niles, Mich.

[ * ] Notice: The portion of the term of this patent subsequent to May 5, 1998, has been disclaimed.

[21] Appl. No.: 145,750

[22] Filed: May 1, 1980

Related U.S. Application Data

[63] Continuation-in-part of Ser. No. 101,069, Dec. 7, 1979, Pat. No. 4,265,090, and Ser. No. 107,261, Dec. 26, 1979, Pat. No. 4,265,092, and Ser. No. 124,544, Feb. 25, 1980, and Ser. No. 141,360, Apr. 18, 1980, and Ser. No. 141,359, Apr. 18, 1980, and Ser. No. 145,712, May 1, 1980.

[51] Int. Cl.[3] ..... F25D 21/08; A47F 3/04

[52] U.S. Cl. ..... 62/155; 62/248; 62/256; 62/282

[58] Field of Search ..... 62/256, 255, 176 A, 62/155, 80, 82, 282, 272, 248

[56] References Cited

U.S. PATENT DOCUMENTS

| | | | |
|---|---|---|---|
| 1,894,205 | 1/1933 | Stollsteimer | 62/248 X |
| 2,542,136 | 2/1951 | Hanson et al. | 62/248 X |
| 2,706,387 | 4/1955 | Swanson | 62/248 |
| 3,462,966 | 8/1969 | Reid et al. | 62/248 |
| 3,465,536 | 9/1969 | Vogel et al. | 62/158 |
| 3,496,732 | 2/1970 | Vogel et al. | 62/158 X |
| 4,117,698 | 10/1978 | Vogel | 62/256 |
| 4,151,954 | 5/1979 | Jacobs | 98/31 X |
| 4,242,882 | 1/1981 | Abraham | 62/256 |
| 4,245,482 | 1/1981 | Abraham | 62/282 X |

*Primary Examiner*—William E. Tapolcai, Jr.

*Attorney, Agent, or Firm*—LeBlanc, Nolan, Shur & Nies

[57] ABSTRACT

A refrigerated display case having a display section within a cabinet and a movable door covering a front access opening to such display section. A refrigeration air conduit extends along the top, bottom and rear walls of the cabinet. The air conduit has an outlet opening and an inlet opening at opposing ends thereof with the openings being in alignment so that air leaving the outlet opening will be directed towards and received by the inlet opening thereby forming an air curtain across the front opening of the cabinet along the path inside the door. During a refrigeration cycle of operation of the display case, refrigerated air is circulated through the air conduit and a refrigeration mechanism arranged within the conduit so as to establish a refrigerated air band and a refrigerated air curtain across the front opening in the cabinet. During a defrost cycle of operation, the refrigeration mechanism is turned off and the door covering the front access opening is slightly opened. An ambient air conduit propels ambient air along the front of the display case during a defrost cycle so that the ambient air then can be drawn into the refrigeration air conduit and circulated through the conduit. Such ambient air serves to defrost the refrigeration mechanism and the interior of the refrigeration air conduit.

11 Claims, 3 Drawing Figures

GLASS DOOR MERCHANDIZER WITH TERTIARY AIR BAND

RELATED APPLICATIONS

The present application is a continuation-in-part of patent applications: Ser. No. 101,069 filed Dec. 7, 1979 now U.S. Pat. No. 4,265,090 and entitled Glass Door Merchandiser with Ambient Air Defrost; and Ser. No. 107,261 filed Dec. 26, 1979 now U.S. Pat. No. 4,265,092 and entitled Refrigerated Display Case Using Air Defrost with Supplemental Heater; and Ser. No. 124,544 filed Feb. 25, 1980 and entitled One and a Half Band Refrigerated Display Case; and Ser. No. 141,360 filed Apr. 18, 1980 and entitled Refrigerated Merchandiser Display Case; and Ser. No. 141,359 filed Apr. 18, 1980 and entitled Merchandiser Display Case Adapted for Energy Conservation; and Ser. No. 145,712 filed May 1, 1980 and entitled Energy Efficient Glass Door Merchandiser. All of these applications are hereby incorporated by reference.

BACKGROUND OF THE INVENTION

The present invention primarily relates to a glass door merchandiser type of refrigerated display case. While reference is made herein to the use of glass doors since those are the types of doors most frequently utilized, other types of doors can be used within the scope of the present invention. In addition, the term refrigerated, in accordance with the present invention, is intended to incorporate both those cases maintained at a temperature either at or in excess of 32° F., such as display cases utilized for displaying milk and fresh foods, and those cases maintained below 32° F., such as frozen food cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display case.

Typically, within the prior art, there have been three different approaches employed for defrosting refrigerated display cases. The three approaches include: utilizing electric resistance heater; passing a compressed gaseous refrigerant through the refrigeration coils; and, circulating ambient air through the air conduit. Due to the increasing cost of energy in recent years, efforts have been made to place more emphasis on the utilization of ambient air defrost systems in place of the electrical resistance heaters or compressed gaseous refrigerant defrost systems.

One type of system that employs ambient air during the defrost cycle is exemplified by those embodiments illustrated in U.S. Pat. Nos. 3,403,525, 3,850,003 and 3,937,033, all to Beckwith et al. These systems use fans separate and distinct from the main circulating fans. The additional fans are turned on only during the defrost cycle of operation for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case.

Such ports are normally closed during the refrigeration cycle and are opened during the defrosting cycle. The Beckwith, et al. U.S. Pat. No. 3,850,003 patent indicates that the concepts described in U.S. Pat. Nos. 3,082,612 and 3,403,525 did not prove to be practical and hence were not commercially feasible.

Another type of ambient air defrosting system is shown in U.S. Pat. No. 4,144,720 issued to Subera, et al. which is assigned to the same assignee as the present application. In the foregoing patent application, an open front refrigerated display case having primary and secondary air conduits is disclosed. In this system, the direction of air flow within one of the conduits is reversed, for example, by the use of reversible fans for ambient air defrost. U.S. Pat. No. 4,026,121 to Aokage, which illustrates an open front display case, and U.S. Pat. No. 4,120,174 to Johnston, which illustrates an open top display case, also disclose reverse ambient air flows for defrosting.

In those ambient air defrost systems disclosed in the above-noted patents which use a reverse air flow, during the defrost cycle of operation, ambient air can easily be drawn through the access opening into the air conduit through the outlet opening of the air conduit and then expelled from the air conduit after the defrost operation through the inlet opening and out of the cabinet through the access opening. Such an arrangement, however, cannot be readily used in a glass door type merchandiser refrigerated display case, since the front opening in the cabinet is covered by the doors. Thus, in order to employ an ambient air defrost system, a different type of system had to be developed.

In seeking to employ ambient air defrost techniques in a glass door case, systems have been developed for drawing in air over a limited portion of the air conduit by opening flaps to the conduit, which flaps are arranged so as to astraddle the evaporator coils of the refrigeration mechanism; such systems are disclosed in U.S. Pat. No. 3,226,945 to Spencer and U.S. Pat. No. 4,072,488 to Johnston. The patent to Spencer illustrates a plurality of different embodiments of open top refrigerated display cases, both of a single shelf and multi-shelf type, in which a glass cover is arranged over the opening in the display case. During the refrigeration cycle of operation, air is drawn through the evaporator coils by a negative pressure created upstream of the coils; such air after being refrigerated is circulated through the air conduit and into the display section of the case. The patent to Johnston discloses a glass door type merchandiser display case in which air is circulated through the air conduit and through the evaporator coils arranged within the air conduit in such a direction that cold air enters from the bottom of the opening in the cabinet and after passing across such opening is then drawn back into the air conduit by an air inlet located at the top of the opening in the cabinet. Such systems are relatively complex and can involve certain operational problems. Where there are moving parts inside of the air conduit an accumulation of frost on such parts can cause them to stick and hence not function properly.

SUMMARY OF THE INVENTION

An object of the present invention is to provide a glass door refrigerated display case with an improved ambient defrost system.

Another object is to provide an improved efficiency glass door refrigerated display case.

A further object of the present invention is to provide an improved ambient air defrosting open front refrigerated display case that has a movable door covering the access opening into the display section of the display case and avoids the problems involved in the operation of the ambient air defrost cycle.

Another object of the present invention is to provide an improved refrigerated display case having a movable door covering the front access opening with an improved ambient air defrost system that provides a flow of ambient air along the front of the display case during the defrost cycle of operation.

Still another object of the present invention is to provide an improved refrigerated display case having a movable door covering its front access opening that provides for a more efficient ambient air defrost operation than previously known display cases of this type.

A still further object of the present invention is to provide an improved glass door merchandiser refrigerated display case utilizing a supplemental electrical heater in conjunction with an improved ambient air defrost system.

These objectives are achieved by the provision of a glass door type refrigerated display case in accordance with the present invention and the operation of such a case in accordance with the present invention. The refrigerated display case of the present invention has a cabinet with top, bottom, rear and side walls with an opening in its front and a display section within the cabinet. At least one door, which is generally a glass door, covers the front opening. The door is movable so as to enable access through the front opening to products within the display section of the display case. An air conduit extends along the top, bottom and rear walls of the cabinet and has an outlet opening and an inlet opening at opposing ends thereof. The outlet opening and the inlet opening are arranged in alignment so that air leaving the outlet opening will be directed towards and received by the inlet opening so as to form an air curtain across the front opening of the cabinet along a path inside of the door. In the air conduit, there are a refrigeration mechanism, which is typically either a single or plurality of evaporator coils, and at least one fan for circulating air through the conduit. The evaporator coils are located upstream of the fan so that air is circulated through the coils by a positive pressure air flow. On top of the display case there is arranged an ambient air conduit and ambient air fans that are capable of providing a flow of ambient air along the front of the display case. This ambient air conduit has its inlet opening located above the display case and its outlet opening facing in a downward direction along the front of the display case.

This display case is capable of being defrosted using ambient air. When a defrost cycle is to occur, a control mechanism switches the display case into a defrost mode. During the defrost mode of operation the evaporator coils are turned off, the ambient air fans are actuated so that there is a flow of ambient air along the front of the display case and such ambient air is drawn into the refrigeration air conduit and circulated through at least a substantial portion of such conduit, including that portion along the rear wall of the cabinet and that portion containing the evaporator coils, thereby defrosting the evaporator coils in the interior of the air conduit. Since the inlet opening of the ambient air conduit is above the display case the ambient air fans draw in air from above the case which is substantially warmer than the air in front of the display case. After the ambient air has passed through the air conduit, it is substantially expelled from the cabinet through the front access opening. In order to allow the ambient air to be so expelled, during the defrost cycle of operation, the door covering the access opening is opened slightly, preferably approximately one inch. The ambient air then can be directed so as to be expelled from the conduit in a direction out through the opening formed by the open door and in a path away from the display case.

The air outlet and inlet openings of the refrigeration air conduit are aligned along a substantially vertical path across the front opening of the cabinet with the air outlet opening being near the top wall of the cabinet. Thus, during a refrigeration cycle of operation, a curtain of refrigerated air extends in a substantially vertical direction flowing from top to bottom across the front opening of the cabinet. During the defrost cycle of operation, the direction of air flow through the conduit is reversed as compared to the direction of air flow during a refrigeration cycle of operation.

As disclosed in my copending application Ser. No. 145,712 filed May 1, 1980 and entitled Energy Efficient Glass Door Merchandiser, the ambient air flow from the ambient air conduit can be used for minimizing condensation within the glass doors. For this purpose the ambient air conduit is provided with an outlet opening with two portions. The first outlet opening portion is positioned so that it creates a flow of ambient air through the glass door when it is in its closed position. For this purpose both the top and bottom frame portions of the door have a plurality of perforations thereby allowing the air to enter the space between the two glass members of the door, flow through the door and then be expelled from the door. The second outlet opening portion of the ambient air conduit is positioned so that it creates a flow of ambient air across the front of the case along a path lying outside of the glass door.

While reference is made herein to the utilization of a fan for circulating air through the air conduit, it is noted that more than one fan may be utilized within the display case. The number of fans employed depends on the length of the display case. Typically, an eight foot long display case utilizes two air circulating fans and a twelve foot case would use three air circulating fans. The number of fans, however, can be varied depending on the length of the case and the sizes of the fans. Likewise, the number of doors covering the front opening of the cabinet would vary depending on the length of the display case, with more doors being utilized for longer display cases. The doors are attached to the case by hinges that are spring biased for closing the doors.

During the defrost cycle of operation care must be taken to ensure that the reverse air flow is not so great that the air expelled from the inlet opening travels across the access opening and is drawn back into the refrigeration air conduit through the outlet opening. While some air might re-enter the refrigeration air conduit, in order to prevent or at least minimize such an occurrence, it is preferrable for the air flow during the defrost cycle of operation to be less than the flow during the refrigeration cycle of operation. Such a defrost air flow would be sufficiently low so as to avoid the above-mentioned problem.

In the operation of the embodiments, during the defrost cycle the door covering the front access opening in the cabinet is opened slightly to provide an open gap of between one and four inches preferably about one inch for drawing in ambient air. To accomplish this, a motor is connected to a drive linkage with a separate push rod associated with each door and arranged for pushing each door open during the defrost cycle. While a single motor can be used for controlling all of the doors of the display case, it is possible to use a separate motor for controlling each door. The motors typically would be mounted on the top of the cabinet and each motor has a pivotable lever that is arranged in contact with a pin member extending upwardly above the top of the door.

To assist in the defrosting operation, a supplemental defroster can be located in the conduit upstream of the refrigeration coils in the direction of air flow through the conduit on the defrost cycle. A sensing and control mechanism is coupled with the supplemental defroster for sensing defrost conditions during the defrost cycle and or energizing the supplemental defroster upon the detection of an abnormal defrost condition to thereby accelerate the rate of defrost.

With air defrost the heat is extracted from the ambient in two forms, sensible heat and latent heat. Sensible heat comes from withdrawing the air at a specific temperature and after it passes through the evaporator coil it will be expelled from the display case at a lower temperature, e.g. 20°-30° F. less. Latent heat is obtained since the evaporator coils, which will be at −20° to −40° F., will cool the air below the dew point and extract moisture out of the air, this moisture when condensed represents a heat source. With every pound of moisture condensed, about 1300 BTUs will be released. Therefore, with low humidity and temperature the heat extracted from the air will diminish and as a result the defrost time will be increased. In some applications the product will not tolerate a lengthy defrost such as in the case of the ice cream merchandisers. Under such conditions a small amount of electrical resistance heat can be used in order to expedite the defrosting operation. For a 12' long case the electrical resistance can be approximately 700 watts.

In operating the refrigerated display case of the present invention, air is circulated through the air conduit in a direction so that the refrigerated air is propelled through the refrigeration mechanism by a positive pressure air flow and such air is circulated through the conduit so as to flow in a substantially vertical direction across the opening in the cabinet in a direction flowing from the top to the bottom of such opening. Such air flow creates a refrigerated air curtain lying along a substantially vertical path with such curtain being located immediately inside of the movable door of the display case. During a defrost cycle of operation, the direction of air flow through the air conduit is reversed and ambient air is drawn into the air conduit, which ambient air serves to defrost the interior of the conduit and the refrigeration mechanism.

DESCRIPTION OF THE PREFERRED EMBODIMENTS

Figure 1:
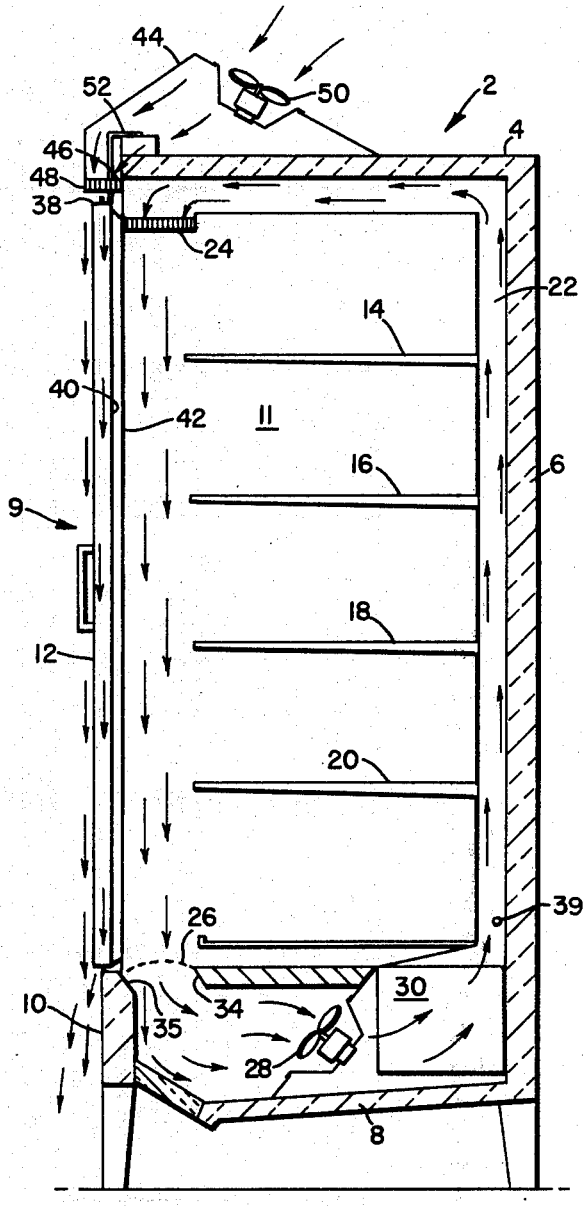
FIG. 1 is a side cross-sectional view of a refrigerated display case in accordance with the present invention when such display case is operating in a refrigeration cycle of operation.

A glass door refrigerated display case 2 has a top wall 4, a rear wall 6, a bottom wall 8 and a front wall 10, as shown in FIG. 1. A glass door 12 covers the access opening 9 to the interior display space 11 of the display case. Within display case 2 are a plurality of shelves, 14, 16, 18 and 20, for the refrigerated products. Encircling interior display space 11 of the glass door merchandiser is a refrigeration air conduit 22. Air conduit 22 has an outlet opening 24 and an inlet opening 26 that are arranged in alignment so that air emitted from outlet opening 24 is directed across access opening 9 inside of interior display space 11 and returns back into the conduit through inlet opening 26.

As the air is circulated through refrigeration air conduit 22, the air is refrigerated by an evaporator coil 30. A set of fans such as represented by fan 28 circulate the air through the refrigeration air conduit in a first direction during the refrigeration cycle of operation such as represented by the arrows in FIG. 1.

Glass door 12 includes a frame 38 in which two glass members 40 and 42 are mounted. An air space exists between glass members 40 and 42 so that ambient air can be circulated between such space. The ambient air flow through glass door 12 is illustrated by the arrows within the door shown in FIG. 1. By circulating ambient air through glass door 12, an accumulation of condensation within the door due to the temperature and moisture differential between the ambient air outside of display case 2 and the refrigerated air inside of display case 2 is substantially if not totally prevented.

The ambient air flow through glass door 12 is created by ambient air conduit 44. Ambient air conduit 44 has an outlet opening with two portions 46 and 48. Portions 46 of the outlet opening of conduit 44 is arranged so as to direct air through glass door 12. For this purpose, the top portion of frame member 38 is provided with a plurality of perforations that allow air to enter the space between glass members 40 and 42. Similarly the bottom of frame 38 is provided with perforations for enabling the air that has passed between the space within the glass door to be emitted from the door. The second portion, 48, of the outlet opening of conduit 44 directs a flow of ambient air along the outside of glass door 12. This flow of ambient air further serves to eliminate condensation buildup on the exterior of glass member 40. The air circulated through conduit 44 is drawn into the conduit by a fan 50 from the ambient air above display case 2.

In order to defrost display case 2, ambient air is caused to flow through refrigeration air conduit 22 at the same time that evaporator coil 30 is temporarily turned off. In order to enable ambient air to be drawn into the display case, a motorized mechanism 52 causes glass door 12 to open slightly. Glass door 12 opens by a sufficient amount (normally a gap of between 1 and 4 inches) for allowing the requisite ambient air to be drawn into the air conduits, circulated through the conduits and subsequently expelled from the display case through the glass door.

Figure 2:
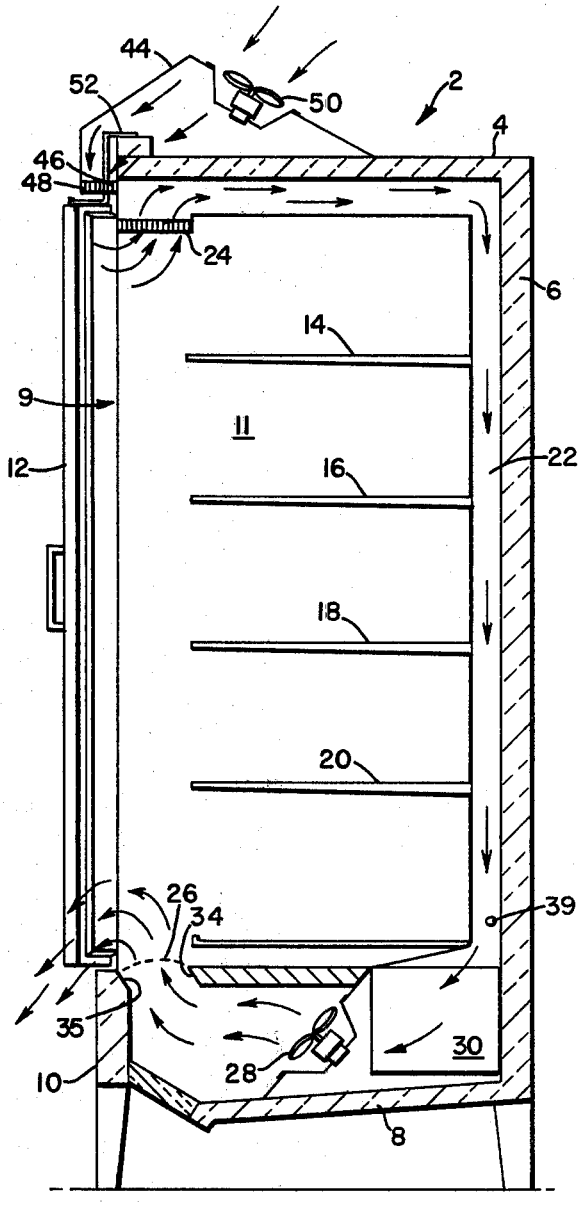
FIG. 2 is a view of the refrigerated display case shown in FIG. 1 when such display case is operating in a defrost cycle of operation.

During the defrost cycle of operation, the gap formed by the opening of glass door 12 allows ambient air to be drawn into air conduit 22, such as shown in FIG. 2. For this purpose the operation of the fans is reversed so as to reverse the air flow through the air conduits. By simultaneously continuing the operation of fan 50 during the defrost cycle of operation, a stream of ambient air emitted through outlet openings 46 and 48 can be drawn into outlet openings 24 and 36 of air conduits 22 and 32, respectively. The air is drawn into the outlet opening since during the defrost cycle of operation the direction of air flow has been reversed. Simultaneously, evaporator coil 30 is temporarily deactivated. Thus, ambient air flows through the air conduits in a direction opposite to the air flow during a refrigeration cycle and is expelled from conduit 22 through inlet opening 26. By sloping the walls 34 and 36 of the conduit in the area of inlet opening 26 the ambient air is directed towards glass door 12 which assists in having the air expelled from the display case such as shown by the arrows in FIG. 2.

In order to decrease the time period necessary for completing the defrost operation, a supplemental electrical resistance heater 39 can be utilized. As mentioned above and as discussed in my copending application Ser. No. 107,261, such a heater is only actuated when the conditions, primary the temperature and moisture of the ambient air, require the application of additional heat in order to keep the defrost time period within certain predetermined limits. The primary utilization of such an electrical heater would be in ice cream cases, where the length of the defrost assumes a greater significance.

The supplemental heat source includes an elongated heater 39, such as calrod heating element. Heating element 39 is located in the refrigeration air flow conduit upstream of the evaporator coils, considered in the air flow direction in the defrost cycle. The supplemental heater 39 may be energized in any one of several ways to aid in the rapid defrosting of the evaporator coils. In one embodiment, the supplemental heater may be energized by a control which senses the moisture content in the air; one such control device is marketed by Minneapolis Honeywell Company as "Dew Point Controller 4-409A". The dew point controller measures the moisture content in the air; when the measured humidity is below a preset limit, indicating low moisture content condition, and thus low latent heat available for defrosting, the supplemental heater will be energized.

For example, supplemental heat may be required when the measured dew point temperature is below 35° F.

In the alternative embodiment, the dew point or demand controller may be replaced by a timer controlled device; for example, if the defrost cycle does not terminate within a predetermined time, for example, after 30–35 minutes, the controller will then energize the supplemental heater to speed up the defrost cycle.

Figure 3:
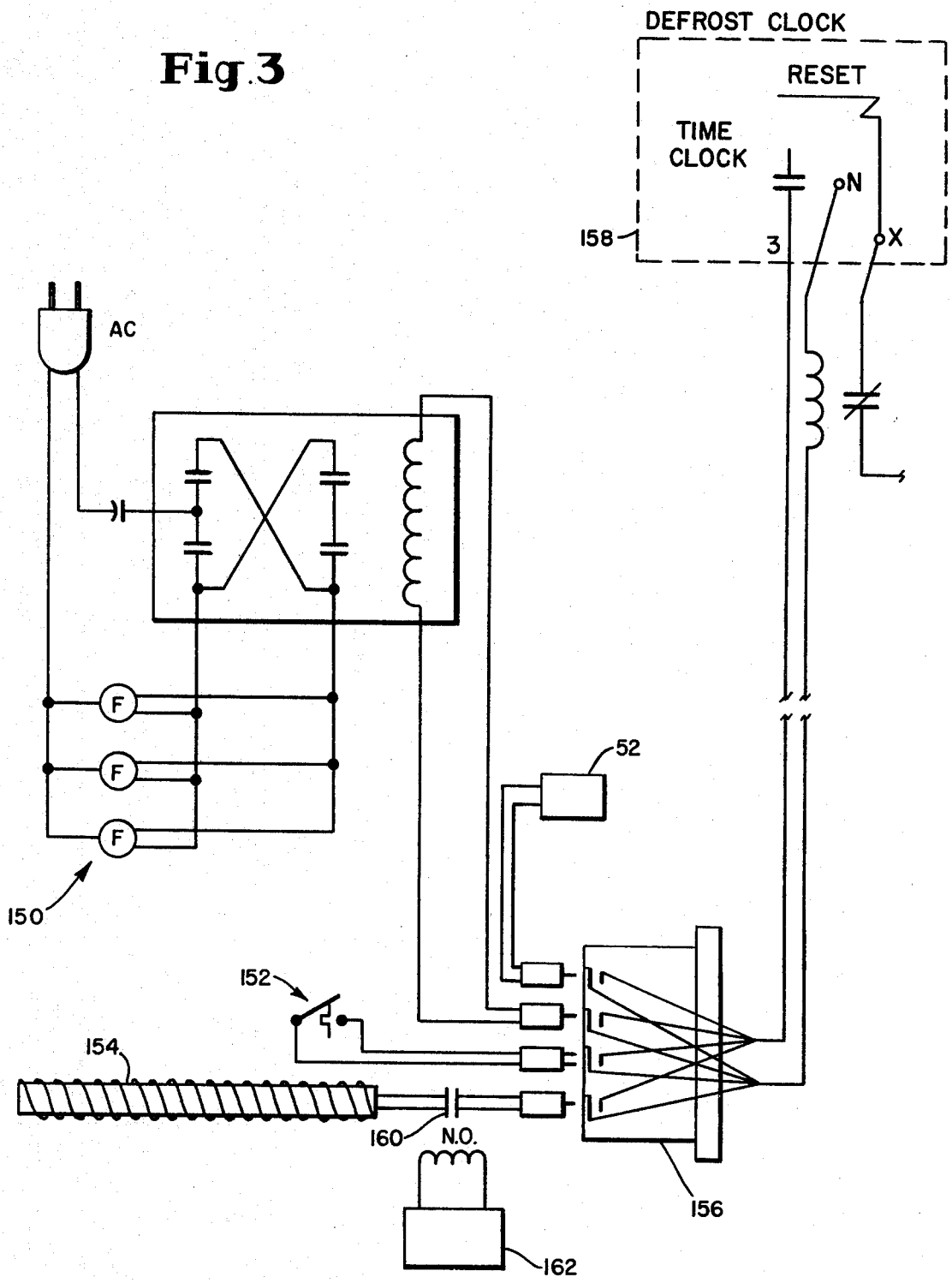
FIG. 3 is a circuit diagram of the supplemental heater control circuit.

In either embodiment, the supplemental heater and the heater controller are electrically connected to the defrost controller. Referring to FIG. 3, reversible fan motors 150, a defrost limit switch 152, and a supplemental heater 154 are connected through a multi-socket plug 156 to a defrost controller 158. A normally open relay 160 controls operation of the supplemental heater when the defrost cycle is activated by controller 158. A dew pointer or timer 162 closes relay 160 when an abnormal defrost condition is detected.

The supplemental heater is energized only during the defrost cycle and then only when the necessary condition (e.g. low moisture content or excessive defrost time) is detected. In this way, supplemental defrost heat is added only when necessary during defrost and only during defrost, thereby resulting in a significant contribution to energy conservation.

The present invention may be embodied in other specific forms without departing from the spirit or essential characteristics thereof. The present embodiments are presented as merely illustrative and not restrictive, with the scope of the invention being indicated by the attached claims rather than the foregoing description. All changes which come within the meaning and range of equivalency of the claims, therefore, are intended to be embraced therein.

I claim:

1. A refrigerated display case comprising:

a cabinet having top, bottom, rear and front walls and an interior display space, with an access opening in said front wall for enabling access into said interior display space;

at least one door covering said access opening in said front wall, said door being movable into an open position for enabling access to products in said interior display space;

a refrigeration air conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated air curtain across said front opening along a path inside of said door;

refrigeration means including an evaporator coil arranged within said refrigeration air conduit for refrigerating air circulated through said refrigeration air conduit during a refrigeration cycle of operation;

first air circulating means for circulating air through said refrigeration air conduit;

an ambient air conduit mounted on the top of said display case, said ambient air conduit having an inlet opening located above said display case and an outlet opening arranged for directing a flow of ambient air along the front of said display case;

ambient air circulating means for circulating air through said ambient air conduit;

opening means for partially opening said door;

terminating means temporarily terminating operation of said refrigeration means; and, control means for switching said refrigerated display case into a defrost cycle of operation, during such defrost cycle of operation said control means causes said terminating means to temporarily turn off said refrigeration means, causes said opening means to open said door and causes ambient air from said ambient air conduit to be drawn into and circulated through said refrigeration air conduit.

2. A refrigerated display case according to claim 1, wherein said control means causes said first air circulating means to circulate ambient air through said refrigeration air conduit in a direction opposite to the direction of flow of air during a refrigeration cycle of operation.

3. A refrigerated display case comprising:

a cabinet having top, bottom, rear and front walls and an interior display space, with an access opening in said front wall for enabling access into said interior display space;

at least one glass door permanently connected to said cabinet and covering said access opening in said front wall for forming a closed interior refrigerated space when said door is in its closed position, said glass door having two sheets of glass mounted in a frame member with a space between said sheets of glass and said glass door being movable into an open position for enabling access to products in said interior display space;

a refrigeration air conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated air curtain across said front opening along a path inside of said door;

refrigeration means including an evaporator coil arranged within said refrigeration air conduit for refrigerating air circulated through said refrigeration air conduit during a refrigeration cycle of operation;

first air circulating means for circulating air through said refrigeration air conduit;

an ambient air conduit mounted on the top of said display case, said ambient air conduit having an inlet opening located above said display case and an outlet opening arranged for directing a flow of ambient air along the front of said display case outside of said closed interior refrigerated space when said door is in its closed position; and, ambient air circulating means for circulating air through said ambient air conduit and said means for circulating ambient air causing ambient air to be circulated through and over said glass door when said door is in its closed position.

4. A refrigerated display case according to claim 3, wherein said means for circulating ambient air through said door further includes means for establishing an ambient air flow along the outside of said door when said door is in its closed position.

5. A refrigerated display case according to claim 4 further comprising: opening means for partially opening said door; terminating means for temporarily terminating operation of said refrigeration means; and control means for switching said refrigerated display case into a defrost cycle of operation, during such defrost cycle said control means causes said terminating means to temporarily turn off said refrigeration means, causes said opening means to open said door and causes ambient air from said ambient air conduit to be drawn into and circulated through said refrigeration air conduit.

6. A refrigerated display case according to claim 5 wherein said control means causes said first air circulating means to circulate ambient air through said refrigeration air conduit in a direction opposite to the direction of flow during a refrigeration cycle of operation.

7. A refrigerated display case according to claim 1, 2, 5 or 6 further comprising supplemental defrost means located in said refrigeration air conduit upstream of said refrigeration means in the direction of air flow through said refrigeration air conduit in the defrost cycle of operation.

8. A refrigeration display case according to claim 7 further comprising sensing and control means coupled with said supplemental defrost means for sensing defrost conditions during the defrost cycle and energizing said supplemental defrost means upon the detection of certain predetermined defrost conditions so as to accelerate the rate of defrost.

9. A refrigerated display case according to claim 8 wherein said supplemental defrost means comprises an electrical heater and said sensing and control means comprises means for detecting relative humidity in the ambient air and for energizing said supplemental defrost means only during a defrost cycle when the detected relative humidity falls below a predetermined level.

10. A refrigerated display case according to claim 8, wherein said supplemental defrost means comprises an electrical heater and said sensing and control means comprises means for detecting the duration of the defrost cycle and for energizing said supplemental defrost means only during the defrost cycle when the detected length of the defrost cycle exceeds a predetermined duration.

11. A refrigerated display case according to claim 1 or 3 wherein said ambient air circulating means is only actuated during a defrost cycle of operation.

* * * * *